US005897714A

United States Patent [19]

Heineman et al.

[11] Patent Number: 5,897,714

[45] Date of Patent: Apr. 27, 1999

[54] BASTARD SUGAR PRODUCT, AND PROCESS FOR PRODUCING SUCH A BASTARD SUGAR PRODUCT

[75] Inventors: Hubertus Willem Borritius Heineman, Bussum; Paul Maria Theophiel Van Heeschvelde, Prinsenbeek; Bernard Molenaar, Doorn, all of Netherlands

[73] Assignee: CSM Suiker B. V., Amsterdam, Netherlands

[21] Appl. No.: 08/987,351

[22] Filed: Dec. 9, 1997

[30] Foreign Application Priority Data

Dec. 9, 1996 [NL] Netherlands ..... 1004734

[51] Int. Cl.[6] ..... C13F 3/00

[52] U.S. Cl. ..... 127/30; 127/63

[58] Field of Search ..... 127/30, 63

[56] References Cited

U.S. PATENT DOCUMENTS

| | | | |
|---|---|---|---|
| 2,145,893 | 2/1939 | Robinson . | |
| 3,506,457 | 4/1970 | Gidlow et al. | 127/30 |
| 3,584,617 | 6/1971 | Stachenko | 127/63 |
| 3,615,699 | 10/1971 | Mickevicz | 127/30 |
| 3,652,298 | 3/1972 | Mickevicz . | |
| 4,362,757 | 12/1982 | Chen et al. | 526/599 |

FOREIGN PATENT DOCUMENTS

| | | |
|---|---|---|
| 0 052 413 | 5/1982 | European Pat. Off. . |
| 2 143 244 | 2/1973 | France . |
| 20 20 982 | 11/1970 | Germany . |

*Primary Examiner*—David Brunsman
*Attorney, Agent, or Firm*—Young & Thompson

[57] ABSTRACT

The invention relates to a bastard sugar product which, in addition to good baking properties, is also free-flowing and ensilable. Such a product is characterized by an average particle size in the range 0.2–0.6 mm, advantageously 0.3–0.5 mm, an invert sugar content of 0.5–2.5% by wt, preferably 1.5–2.0% by wt, a moisture content of not more than 0.25% by wt, advantageously not more than 0.2% by wt and in particular not more than 0.1% by wt, and an $\alpha'/\alpha_{ref}$ value (cf. SOTAX FLOWTEST FT-300) of at least 0.9. Such a bastard sugar product can be obtained by comminuting granulated sugar, sieving the comminuted granulated sugar, removing the dust fraction and mixing the dust-free comminuted granulated sugar fraction with invert sugar to give a homogeneous product.

10 Claims, No Drawings

BASTARD SUGAR PRODUCT, AND PROCESS FOR PRODUCING SUCH A BASTARD SUGAR PRODUCT

The invention relates to a "bastard sugar" [soft brown sugar] product which has good flow properties and excellent storage stability.

As is generally known, bastard sugar is mainly used in dough for confectionery products in both traditional and industrial bakeries. Advantages which can be ascribed to this use of bastard sugar are:

1) the baked product has more lively and flowing baking properties, i.e. it is lighter in texture. This is also attributed to the specific grain size distribution of the bastard sugar with an average particle size MA of 0.4 mm and a CV of about 60% (CV=coefficient of variation=($\alpha$/MA)×100); (ICUMSA GS2-37);
2) the colouring capacity of the baked product in the oven is higher, i.e. a fresh, golden yellow colour is produced because of the amount of invert sugar (glucose:fructose=1:1) present in the bastard sugar, in an amount of at least 0.5% by wt and normally in the range 0.7–2.5% by wt.

The traditional product bastard sugar can be produced, for example, as follows.

About 60 g of granulated sugar (sucrose) is dissolved in water under normal conditions. A small amount of acid, such as citric acid, is then added, after which a small amount of sucrose is converted to invert sugar (splitting of sucrose into glucose and fructose in a molar ratio of 1:1) by hydrolysis, with boiling of the sucrose solution. This quantity of invert sugar which is obtained is at least 0.5% by wt and normally amounts to 0.7–2.5% by wt. The solution is then crystallized out, giving a bastard sugar product with a moisture content of not more than 10% by wt, usually 0.5–3% by wt. Because of this moisture content, traditional bastard sugar has a sandy and sticky, and sometimes even a syrupy character, as a result of which this bastard sugar—in spite of stringent drying conditions—is susceptible to lumpiness and, in addition, is not free-flowing. Because of these disadvantageous properties, traditional bastard sugar is unsuitable for packaging in types of packaging on a larger scale than the present 25 kg plastic bag.

The object of the invention is therefore to develop a solution to the above problem, i.e. to develop a bastard sugar product which both has the aforesaid favourable properties and is free-flowing and can be stored in large-scale types of packaging.

The object according to the invention is surprisingly achieved with a bastard sugar product, which product has an average particle size in the range 0.2–0.6 mm, an invert sugar content of 0.5–2.5% by wt, a moisture content of not more than 0.25% by wt and an $\alpha'/\alpha_{ref}$ value (cf. SOTAX FLOWTEST FT-300) of at least 0.9. Such a product is free-flowing and "ensilable", i.e. it can be stored and transported in large-scale types of packaging such as big-bags, multi-purpose silos and bulk trucks.

More particularly, the bastard sugar product according to the invention has an average particle size in the range 0.3–0.5 mm, more particularly a particle size of 0.4 mm with a CV (coefficient of variation) of 40–80%, in particular about 60%.

The invert sugar content of the bastard sugar product according to the invention is advantageously 0.7–2.5% by wt, in particular 1.5–2.0% by wt.

In addition, the moisture content or water content of the bastard sugar product according to the invention is of particular importance and amounts to not more than 0.2% by wt if possible, and most preferably to not more than 0.1% by wt.

The bastard sugar product according to the invention, as defined above, can be obtained for example as follows:

Commercially available granulated sugar which advantageously has an average particle size of 0.6–0.9 mm and a moisture content of not more than 0.05% by wt is comminuted with the aid of a rolling or grinding device, after which the product obtained is sieved through a sieve with a mesh width of 200 microns. The product which passes through the sieve is removed. The product which is retained on the sieve is then homogeneously mixed in a blender with the above-mentioned desired quantity and commercially available invert sugar, which advantageously has an average particle size of about 0.4 mm and a moisture content of not more than 0.05% by wt, in order that the bastard sugar product according to the invention is obtained.

As stated above, the bastard sugar product obtained according to the invention combines the known favourable baking properties of traditional bastard sugar with the above-mentioned excellent flow properties, which make large-scale types of packaging and ensiling (storage in silos) possible. It has also been observed that the new bastard sugar product gives a flavour improvement to the final product (cake, pastry).

For the sake of completeness it is pointed out that in the context of the invention the product "bastard sugar" should be understood to mean yellow and brown bastard sugar as well as white bastard sugar. More particularly, yellow or brown bastard sugar is the same as white bastard sugar to which a relevant amount of caramel has been added.

The excellent flow properties of the products according to the invention can be made clear with the tests below.

TEST 1—FUNNEL TEST (a) traditional bastard sugar and (b) bastard sugar according to the invention are placed on a funnel with a top diameter of 10 cm and a pipe diameter of 0.7 cm. The properties of both products are given in Table A below.

TABLE A

| | Traditional bastard sugar | Bastard sugar according to the invention |
|---|---|---|
| Grain size distribution | 0.4 mm<br>CV = 60% | 0.4 mm<br>CV = 60% |
| Invert sugar content | 1.8% by wt | 1.8% by wt |
| Moisture content | 0.9% by wt | <0.1% by wt |

250 g of both types of bastard sugar was put on each of the funnels. The traditional bastard sugar was clearly non-flowing and got stuck in the funnel, whereas the bastard sugar according to the invention flowed through rapidly without any problem.

TEST 2—SOTAX FLOWTEST FT-300

In the SOTAX FLOWTEST FT-300 (SOTAX A.G., Switzerland), the flow properties of a product are tested under six standardized conditions. This test gives an average value for the angle of flow, $\alpha'$, in the six tests, which is compared with the reference angle of flow, $\alpha_{ref}$ (the reference product is dry quartz sand with a particle size of 0.7–1.2 mm and with an $\alpha_{ref}$ of 82°). The resultant flow angle quotient $\alpha'/\alpha_{ref}$ is a measure of the flow properties of the product tested, which measure can range from less than 0.3 (very poor flow properties) to more than 0.9 (very good flow properties).

When the SOTAX FLOWTEST FT-300 was carried out with both the products given in Table A, it was found that the $\alpha'/\alpha_{ref}$ value for the bastard sugar product according to the invention was equal to 1.01, which means that the flow properties of the product according to the invention are as good as those of dry quartz sand with a particle size of 0.7–1.2 mm, and the $\alpha'/\alpha_{ref}$ value of the traditional bastard sugar product was less than 0.3, which means that the traditional product has very poor flow properties.

What is claimed is:

1. Bastard sugar product, characterized in that the product has an average particle size in the range 0.2–0.6 mm, an invert sugar content of 0.5–2.5% by wt, a moisture content of not more than 0.25% by wt and an $\alpha'/\alpha_{ref}$ value (cf. SOTAX FLOWTEST FT-300) of at least 0.9.

2. Bastard sugar product according to claim 1, with the characteristic that the product has an average particle size in the range 0.3–0.5 mm.

3. Bastard sugar product according to claim 2, characterized in that the product has an average particle size of 0.4 mm with a CV of 40–80%.

4. Bastard sugar product according to one or more of claim 1, characterized in that the product has an invert sugar content of 0.7–2% by wt.

5. Bastard sugar product according to claim 4, characterized in that the product has an invert sugar content of 1.5–2.0% by wt.

6. Bastard sugar product according to one or more of claim 1, characterized in that the product has a moisture content of not more than 0.2% by wt.

7. Bastard sugar product according to claim 6, characterized in that the product has a moisture content of not more than 0.1% by wt.

8. Process for the production of a bastard sugar product, as defined according to one or more of claim 1, characterized in that granulated sugar as the starting material is comminuted, the comminuted granulated sugar material is sieved to remove the dust fraction of the comminuted granulated sugar material, and the comminuted granulated sugar material obtained is then mixed with invert sugar in crystalline form.

9. Process according to claim 8, characterized in that granulated sugar with an average grain size of 0.6–0.9 mm and a moisture content of not more than 0.05% by wt is used as the starting material.

10. Process according to claim 8, characterized in that invert sugar with an average grain size of about 0.4 mm and a moisture content of not more than 0.05% by wt is used.

* * * * *